US010436411B2

(12) United States Patent
Zanma

(10) Patent No.: US 10,436,411 B2
(45) Date of Patent: Oct. 8, 2019

(54) LIGHT AMOUNT CONTROL MECHANISM FOR VEHICLE HEADLIGHT

(71) Applicant: Stanley Electric Co., Ltd., Tokyo (JP)

(72) Inventor: Yasuyuki Zanma, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/110,100

(22) Filed: Aug. 23, 2018

(65) Prior Publication Data

US 2019/0063714 A1 Feb. 28, 2019

(30) Foreign Application Priority Data

Aug. 24, 2017 (JP) ..... 2017-160849

(51) Int. Cl.
*F21S 41/692* (2018.01)
*F21S 41/40* (2018.01)
*F21S 41/689* (2018.01)

(52) U.S. Cl.
CPC ..... *F21S 41/692* (2018.01); *F21S 41/40* (2018.01); *F21S 41/689* (2018.01)

(58) Field of Classification Search
CPC .. F21S 41/40–47; F21S 41/683; F21S 41/689; F21S 41/692
See application file for complete search history.

(56) References Cited

U.S. PATENT DOCUMENTS

2001/0010634 A1* 8/2001 Yokoi ..... F21S 41/692 362/512
2003/0048642 A1* 3/2003 Suzuki ..... F21S 41/17 362/509
2003/0081424 A1* 5/2003 Albou ..... F21S 41/689 362/513
2003/0235056 A1* 12/2003 Jong ..... F21S 41/692 362/512
2006/0164852 A1* 7/2006 Mochizuki ..... F21S 41/689 362/539

(Continued)

FOREIGN PATENT DOCUMENTS

JP 2004152728 A * 5/2004
JP 2006269341 A * 10/2006 ..... F21S 41/683

(Continued)

*Primary Examiner* — Mariceli Santiago
(74) *Attorney, Agent, or Firm* — Kenealy Vaidya LLP

(57) ABSTRACT

A light amount control mechanism for a vehicle headlamp can maintain high positional precision of a movable shade in its rotation axis direction to suppress variation in light distribution while allowing stable rotation of the movable shade. The light amount control mechanism includes a movable shade configured to be rotatably supported by a housing and selectively pivots to a first position or a second position to switch a shielding amount of light emitted from a light source, and an actuator configured to drive the movable shade. The light amount control mechanism for a vehicle headlamp may further include a stopper configured to position and hold the movable shade at the first position and the second position, the stopper being constituted by a V-shaped convex portion formed on any one of the movable shade and the housing and a V-groove-shaped concave portion formed on the other thereof as a pair.

3 Claims, 6 Drawing Sheets

(56) References Cited

U.S. PATENT DOCUMENTS

| | | | | |
|---|---|---|---|---|
| 2008/0055921 | A1* | 3/2008 | Suzuki | F21S 41/689<br>362/539 |
| 2013/0258695 | A1* | 10/2013 | Yamazaki | F21S 41/692<br>362/513 |
| 2018/0094787 | A1* | 4/2018 | Abe | F21S 41/255 |

FOREIGN PATENT DOCUMENTS

| | | | | |
|---|---|---|---|---|
| JP | 2010061985 | A | * | 3/2010 |
| JP | 2014-2963 | A | | 1/2014 |
| JP | 2014-7048 | A | | 1/2014 |
| JP | 2014029820 | A | * | 2/2014 |
| JP | 2015-46341 | A | | 3/2015 |

* cited by examiner

FIG. 1
Conventional Art
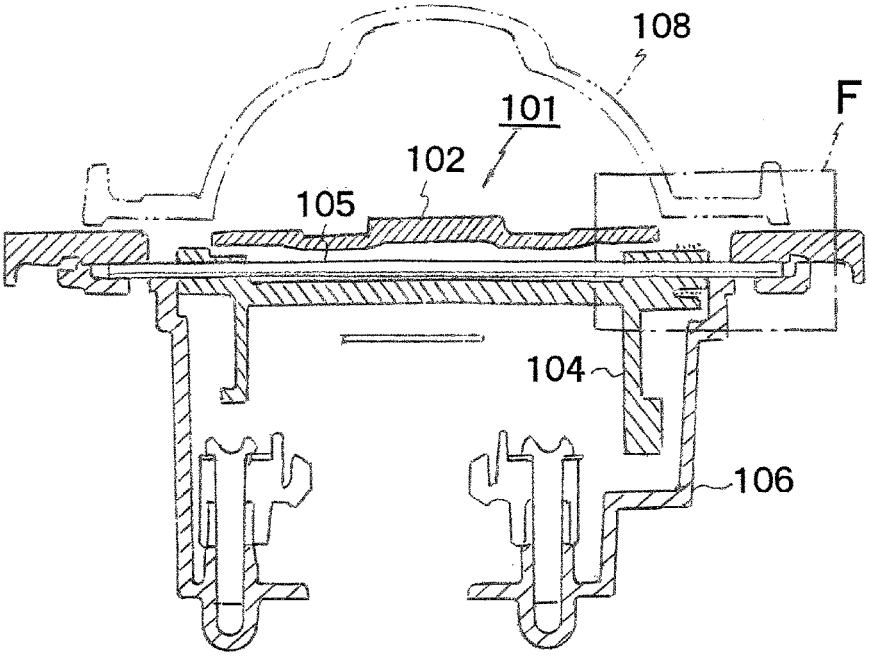
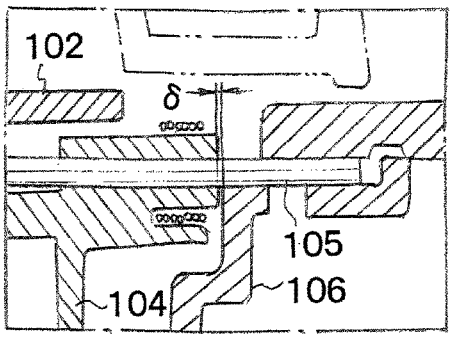
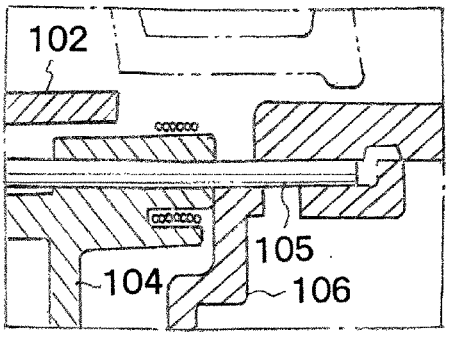
FIG. 2A FIG. 2B
Conventional Art

LIGHT AMOUNT CONTROL MECHANISM FOR VEHICLE HEADLIGHT

This application claims the priority benefit under 35 U.S.C. § 119 of Japanese Patent Application No. 2017-160849 filed on Aug. 24, 2017, which is hereby incorporated in its entirety by reference.

TECHNICAL FIELD

The presently disclosed subject matter relates to a light amount control mechanism for a vehicle headlamp for switching a shielding amount of light emitted from a light source.

BACKGROUND ART

In some headlamps arranged on the left and right sides of the front portion of a vehicle, a light amount control mechanism for switching the amount of shielding of light emitted from the light source can be provided. Examples of such headlamps may include those described in Japanese Patent Application Laid-Open Nos. 2014-002963, 2014-007048, and 2015-046341.

Such a light amount control mechanism can include a movable shade configured to rotatably switch a shielding amount of light emitted from a light source, and an actuator configured to drive the movable shade. In this light amount control mechanism, for example, the movable shade is controlled to rotate to a first position, so that the irradiation mode is switched to a low beam irradiation mode for irradiating a short distance with light, and alternatively, the movable shade is controlled to rotate to a second position, so that the irradiation mode is switched to a high beam irradiation mode for irradiating a long distance with light. Hereinafter, one example of such a conventional light amount control mechanism will be described below with reference to FIGS. 1 and 2A and 2B.

FIG. 1 is a front cross-sectional view of a conventional light amount control mechanism, and FIGS. 2A and 2B are each an enlarged detailed view of a part F of FIG. 1. As illustrated in FIG. 1, a vehicle headlamp is provided with a reflector 108 for reflecting light emitted from a light source (not illustrated) toward the front of the vehicle, and a light amount control mechanism 101 for switching a shielding amount of light reflected by the reflector 108.

In the light amount control mechanism 101, a movable shade 102 is rotatably supported by a housing 106 by a rotary shaft 105 together with a bracket 104. More specifically, the rotatable rotary shaft 105 is inserted through and held in the housing 106 in the width direction (left-right direction in FIGS. 1 and 2A and 2B), and the movable shade 102 and the bracket 104 are coupled to the rotary shaft 105.

The movable shade 102 is housed in the housing 106 and driven by an actuator (not illustrated), such as a solenoid, so that the irradiation mode is switched to the low beam irradiation mode or the high beam irradiation mode by the rotation of the movable shade 102 to move to the first position or the second position.

Incidentally, in the light amount control mechanism 101 illustrated in FIG. 1, the positional precision in the rotation axis direction (width direction) of the movable shade 102 for forming the light distribution is important. However, since the movable shade 102 and the bracket 104 are rotating parts, a predetermined axial gap δ is usually required to be formed between the bracket 104 on the rotating side and the housing 106 on the stationary side as shown in FIG. 2A.

When the axial gap δ is formed between the bracket 104 and the housing 106 in this manner, a backlash in the rotational axis direction (left-right direction in the drawings) is generated in the movable shade 102, and a problem arises in that the backlash of the movable shade 102 causes a variation in light distribution.

In order to solve the above-mentioned problem, as illustrated in FIG. 2B, it is conceivable that an axial gap is not provided between the bracket 104 and the housing 106; however, when the axial gap is not provided, another problem arises that the rotation of the movable shade 102 is not smoothly performed particularly when the bracket 104 and the housing 106 are heated and thermally expanded.

SUMMARY

The presently disclosed subject matter was devised in view of these and other problems and features in association with the conventional art. According to an aspect of the presently disclosed subject matter, there can be provided a light amount control mechanism for a vehicle headlamp that can maintain high positional precision of a movable shade in its rotation axis direction to suppress variation in light distribution while allowing stable rotation of the movable shade.

According to another aspect of the presently disclosed subject matter, a light amount control mechanism for a vehicle headlamp may include a movable shade configured to be rotatably supported by a housing and selectively pivots to a first position or a second position to switch a shielding amount of light emitted from a light source, and an actuator configured to drive the movable shade. The light amount control mechanism for a vehicle headlamp may further include a stopper configured to position and hold the movable shade at the first position and the second position, the stopper being constituted by a V-shaped convex portion formed on any one of the movable shade and the housing and a V-groove-shaped concave portion formed on the other thereof as a pair.

In the light amount control mechanism for a vehicle headlamp with the aforementioned configuration, center positions of the pair of convex portion and concave portion which may engage with each other in the first position or the second position are offset from each other in the rotation axis direction of the movable shade.

Here, the V-shaped convex portion and the V-groove shaped concave portion include a first engagement set including a pair of a convex portion and a concave portion that engage with each other when the movable shade is in the first position, and a second engagement set including another pair of a convex portion and a concave portion that engage with each other when the movable shade is in the second position, and center positions of the convex portion and the concave portion of at least one of the first engagement set and the second engagement set are offset from each other in the rotation axis direction of the movable shade.

According to the aforementioned aspect of the presently disclosed subject matter, in a state in which the movable shade is rotated to be positioned at the first position or the second position, the V-shaped convex portion formed on one of the movable shade on the rotation side and the housing on the stationary side can engage with the V-groove-shaped concave portion formed on the other of them, so that the positioning of the movable shade in the rotation axis direction is precisely achieved. Therefore, a backlash in the rotation axis direction cannot be generated in the movable shade, so that variations in light distribution due to the movable shade can be suppressed. Since the positioning of the movable shade in the rotation axis direction is precisely achieved in this manner, a predetermined axial gap can be set between the movable shade on the rotation side and the housing on the stationary side. This can ensure the stable rotation of the movable shade due to this axial gap.

Furthermore, according to the aforementioned aspect of the presently disclosed subject matter, since the center positions of the pair of convex portion and the concave portion which are engaged with each other in the first position or the second position may be offset in the rotation axis direction of the movable shade, the movable shade can move by the offset amount in the rotation axis direction in the first position or the second position, so that the movable shade can perform the three-dimensional motion of the rotation and the axial movement.

BRIEF DESCRIPTION OF DRAWINGS

These and other characteristics, features, and advantages of the presently disclosed subject matter will become clear from the following description with reference to the accompanying drawings, wherein:

FIG. 1 is a front cross-sectional view of a conventional light amount control mechanism;

FIGS. 2A and 2B are each an enlarged detailed view of a part F of FIG. 1;

DESCRIPTION OF EXEMPLARY EMBODIMENTS

A description will now be given below of a light amount control mechanism for a vehicle headlight of the presently disclosed subject matter with reference to the accompanying drawings in accordance with exemplary embodiments.

First Exemplary Embodiment

Figure 3:
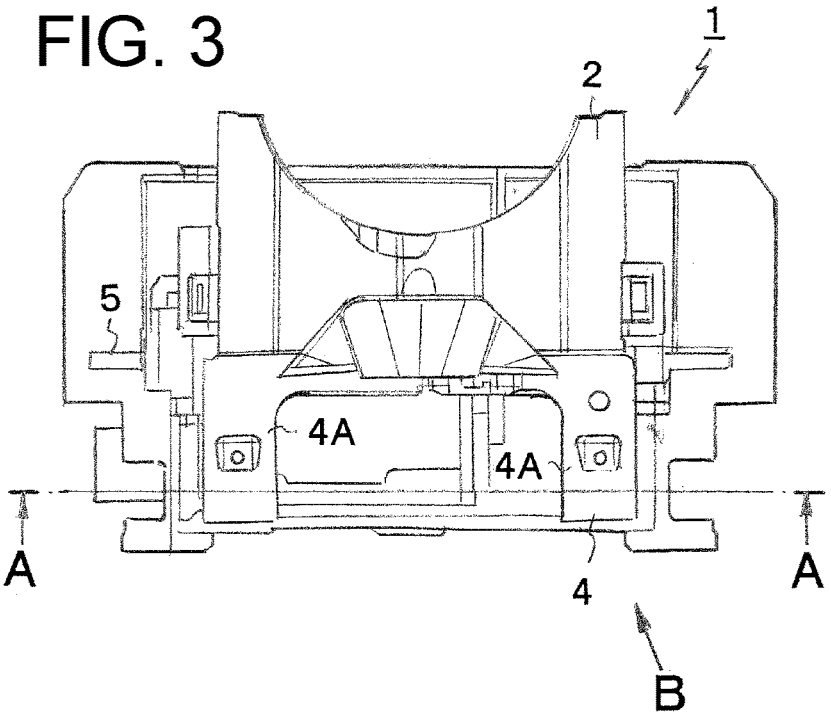
FIG. 3 is a plan view of a light amount control mechanism according to a first exemplary embodiment made in accordance with principles of the presently disclosed subject matter.
Figure 4:
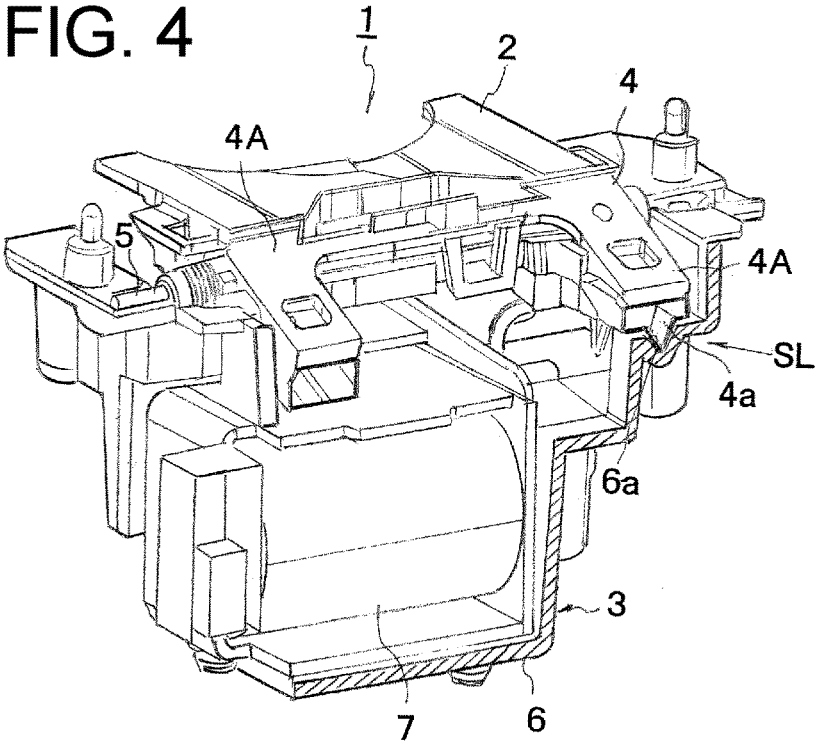
FIG. 4 is a perspective view when the light amount control mechanism of FIG. 3 is cut along line A-A and viewed in an oblique direction.
Figure 5:
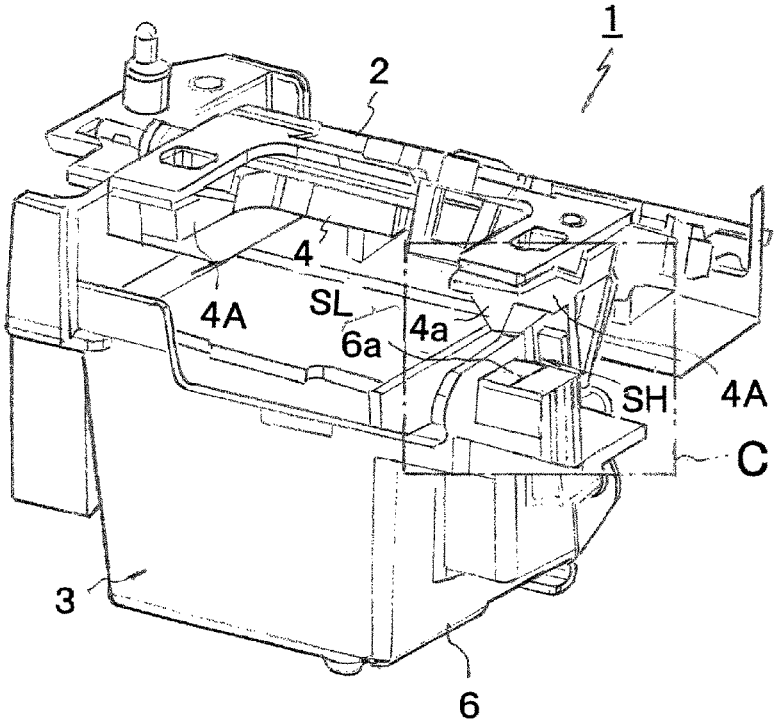
FIG. 5 is a perspective view of the light amount control mechanism of FIG. 3 when viewed in an arrow B direction in FIG. 3.
Figure 6:
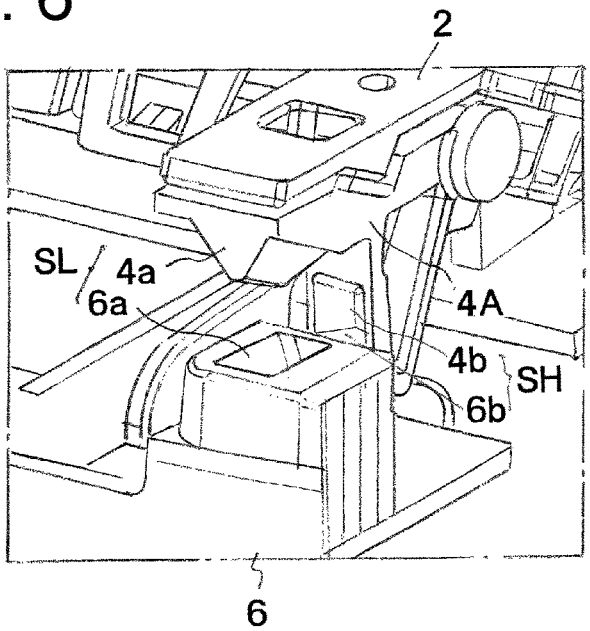
FIG. 6 is an enlarged detailed view of a portion C of FIG. 5.

FIG. 3 is a plan view of a light amount control mechanism made in accordance with the principles of the presently disclosed subject matter according to a first exemplary embodiment; FIG. 4 is a perspective view when the light amount control mechanism of FIG. 3 is cut along line A-A and viewed in an oblique direction; FIG. 5 is a perspective view of the light amount control mechanism of FIG. 3 when viewed in an arrow B direction in FIG. 3; and FIG. 6 is an enlarged detailed view of a portion C of FIG. 5.

The light amount control mechanism 1 according to the present exemplary embodiment can be provided to each headlamp (not illustrated) disposed on the left and right of the front of the vehicle. The light amount control mechanism 1 can include a movable shade 2 configured to rotatably move and switch the shielding amount of light emitted from a light source (not illustrated), and an actuator 3 configured to drive the movable shade 2. Here, the movable shade 2 can be configured to be rotated about a rotation shaft 5 together with a bracket 4 united with the movable shade 2 to switch the position to the first position or the second position, thereby switching the shielding amount of the light from the light source. Here, the bracket 4 can be formed as a part of the movable shade 2. Specifically, in a state where the movable shade 2 is rotated so that its position is switched to the first position (see FIG. 4), the shielding amount of light by the movable shade 2 is large, and the irradiation mode is switched to the irradiation mode for a low beam (passing beam) for irradiating a short distance with light. In contrast to this, in a state where the movable shade 2 is rotated and its position is switched to the second position (see FIG. 5), the shielding amount of light by the movable shade 2 is small, and the irradiation mode is switched to the irradiation mode for a high beam (traveling beam) for irradiating a long distance with light.

The actuator 3 may include a solenoid 7 (see FIG. 4) as a drive source, a cam mechanism (not illustrated), and the like inside a rectangular box-shaped housing 6. The movable shade 2 and the bracket 4 are supported in an upper portion of the housing 6 so as to be rotatable about the rotation shaft 5 (swingable therearound to move in a vertical direction). Specifically, the rotation shaft 5 is inserted into the bracket 4 and fixed in the width direction (left-right direction) to the same. Both longitudinal ends of the rotation shaft 5 are rotatably inserted in and supported by the housing 6. Therefore, the movable shade 2 and the bracket 4 are supported by the housing 6 so as to be rotatable about the rotation shaft 5 (swingable therearound to move in the vertical direction).

Here, the bracket 4 may be formed in an H-shape in plan view, and have arm portions 4A having a bifurcated shape extending on and from both sides of the rotation shaft 5 as a boundary, respectively, as shown in FIGS. 4 and 5.

Thus, the light amount control mechanism 1 according to the present exemplary embodiment can be provided with a low beam stopper SL and a high beam stopper SH configured to position and hold the movable shade 2 at the first position and the second position, respectively. That is, as shown in FIG. 4, one of the left and right arm portions 4A of the bracket 4 (on the right side in FIG. 4) may be provided with a convex portion 4*a* projecting downwardly in a V-shape, and a concave portion 6*a* in a V-groove shape may be formed at a position of the housing 6 corresponding to the convex portion 4*a*. Here, the convex portion 4*a* and the concave portion 6*a* can engage with each other to constitute the low beam stopper SL configured to position the movable shade 2 in the rotational axis direction when the movable shade 2 is in the first position.

Therefore, in a state where the position of the movable shade 2 is switched to the first position, as shown in FIG. 4, the convex portion 4*a* formed in the one arm portion 4A of the bracket 4 can engage with the concave portion 6*a* formed in the housing 6, so that the positioning of the movable shade 2 in the rotational axis direction (left-right direction) can be precisely achieved. Therefore, a backlash in the rotation axis direction is not generated in the movable shade 2, and variation in light distribution due to the movable shade 2 when the low beam irradiation mode is selected as the irradiation mode can be suppressed. Since the positioning of the movable shade 2 in the rotation axis direction is precisely achieved in this manner, a predetermined axial gap can be set between the bracket 4 on the rotation side and the housing 6 on the stationary side, and the stable rotation of the movable shade 2 is ensured by this axial gap.

Further, as shown in FIGS. 5 and 6, a V-groove shaped concave portion 4*b* that opens toward the rear of the vehicle may be formed in one of the left and right arm portions 4A of the bracket 4 (on the right side in the illustrated example in FIGS. 5 and 6), and a convex portion 6*b* that projects in a V-shape toward the front of the vehicle may be formed at a position of the housing 6 corresponding to the concave portion 4*b*. Here, the concave portion 4*b* and the convex portion 6*b* can engage with each other to constitute the high beam stopper SH configured to position the movable shade 2 in the rotational axis direction when the movable shade 2 is in the second position.

Therefore, in the state where the position of the movable shade 2 is switched to the second position (the state shown in FIGS. 5 and 6), as shown in FIG. 5, the concave portion 4*b* formed in the arm portion 4A of the bracket 4 can engage with the convex portion 6*b* formed in the housing 6, so that the positioning of the movable shade 2 in the rotation axis direction (the left-right direction) is precisely achieved. Therefore, no backlash in the rotation axis direction is generated in the movable shade 2, and variation in light distribution by the movable shade 2 when the high beam irradiation mode is selected as the irradiation mode can be suppressed. Since the positioning of the movable shade 2 in the rotation axis direction is precisely achieved in this manner, a predetermined axial gap can be set between the bracket 4 on the rotation side and the housing 6 on the stationary side, so that the stable rotation of the movable shade 2 is ensured by this axial gap.

Second Exemplary Embodiment

Figure 7:
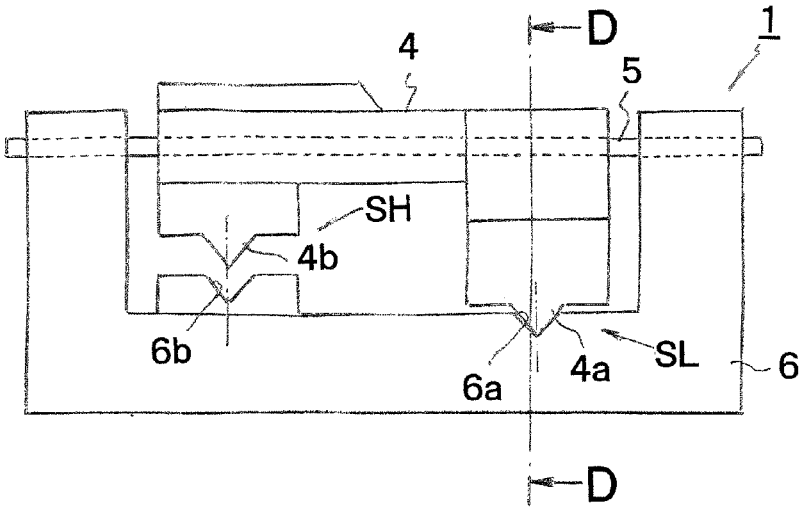
FIG. 7 is an explanatory view showing an engagement state of a concave portion and a convex portion in a low beam stopper portion of a light amount control device according to a second exemplary embodiment of the presently disclosed subject matter.

A description will now be given below of a light amount control mechanism for a vehicle headlight of the presently disclosed subject matter with reference to FIGS. 7 to 9 as a second exemplary embodiment. FIG. 7 is an explanatory view showing the engagement state of a concave portion and a convex portion in a low beam stopper portion of a light amount control device according to the second exemplary embodiment of the presently disclosed subject matter, FIG. 8 is a cross-sectional view taken along line D-D of FIG. 7, and FIG. 9 is an explanatory view showing the engagement state of a concave portion and a convex portion in the high beam stopper portion of the light amount control device according to the second exemplary embodiment.

In the present exemplary embodiment, similarly to the first exemplary embodiment, the light amount control mechanism 1 may be provided with a low beam stopper SL and a high beam stopper SH for positioning and holding the movable shade 2 at the first position and the second position, respectively. That is, as shown in FIG. 7, one of the left and right arm portions 4A of the bracket 4 (on the right side in the illustrated example of FIG. 7) may be provided with a convex portion 4*a* projecting downwardly in a V-shape, and a concave portion 6*a* in a V-groove shape may be formed at a position of the housing 6 corresponding to the convex portion 4*a*. Here, the convex portion 4*a* and the concave portion 6*a* can engage with each other to constitute the low beam stopper SL configured to position the movable shade 2 in the rotational axis direction when the movable shade 2 is in the first position.

Figure 8:
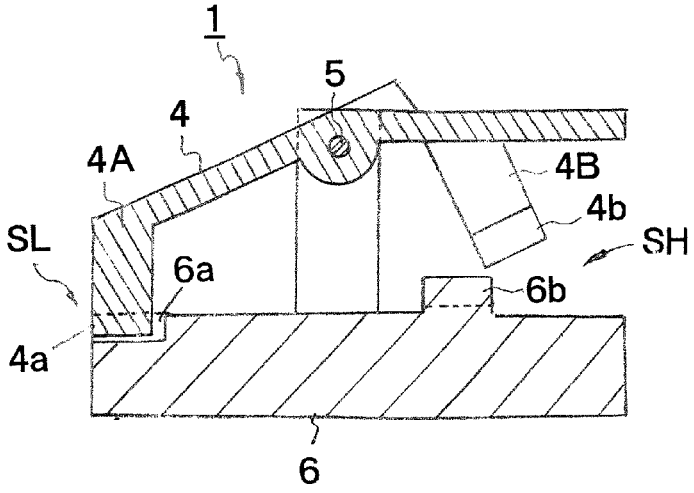
FIG. 8 is a cross-sectional view taken along line D-D of FIG. 7.

On the other hand, as illustrated in FIG. 8, on one (left side in the illustrated example in FIG. 8) of the left and right arm portions 4B on the other side of the bracket 4 (opposite to the arm portion 4A with the rotation shaft 5 interposed therebetween), a convex portion 4*b* that projects downwardly in a V-shape may be formed, and a V-groove-shaped concave portion 6*b* may be formed at a position of the housing 6 corresponding to the convex portion 4*b*. Here, the convex portion 4*b* and the concave portion 6*b* can engage with each other to constitute the high beam stopper SH configured to position the movable shade 2 in the rotational axis direction when the movable shade 2 is in the second position.

Figure 9:
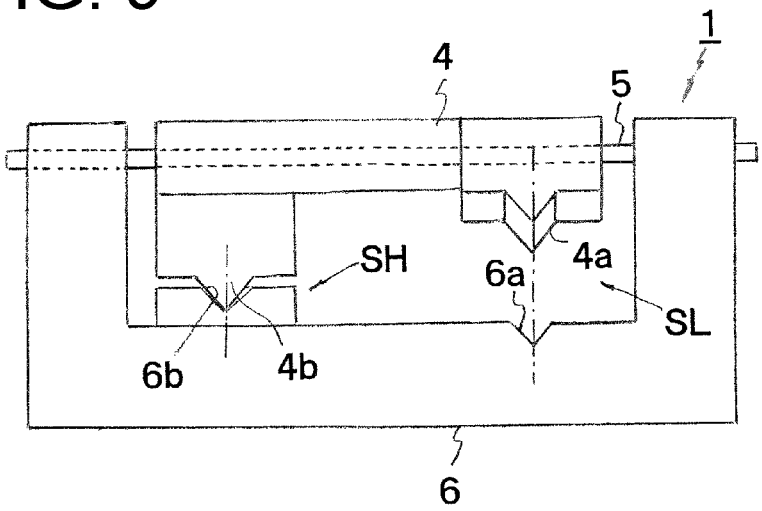
FIG. 9 is an explanatory view showing an engagement state of a concave portion and a convex portion in a high beam stopper portion of the light amount control device according to the second exemplary embodiment.

Therefore, in a state where the position of the movable shade 2 is switched to the second position, as shown in FIG. 9, the convex portion 4*b* formed in the arm portion 4B of the bracket 4 can engage with the concave portion 6*b* formed in the housing 6, so that the positioning of the movable shade 2 in the rotational axis direction (left-right direction) is precisely achieved. Therefore, no backlash in the rotation axis direction is generated in the movable shade 2, and variation in light distribution by the movable shade 2 when the high beam irradiation mode is selected as the irradiation mode can be suppressed. Since the positioning of the movable shade 2 in the rotation axis direction is precisely achieved in this manner, a predetermined axial gap can be set between the bracket 4 on the rotation side and the housing 6 on the stationary side, so that the stable rotation of the movable shade 2 is ensured by this axial gap.

Third Exemplary Embodiment

A description will now be given below of a light amount control mechanism for a vehicle headlight of the presently disclosed subject matter with reference to FIGS. 10 to 12 as a third exemplary embodiment.

Figure 10:
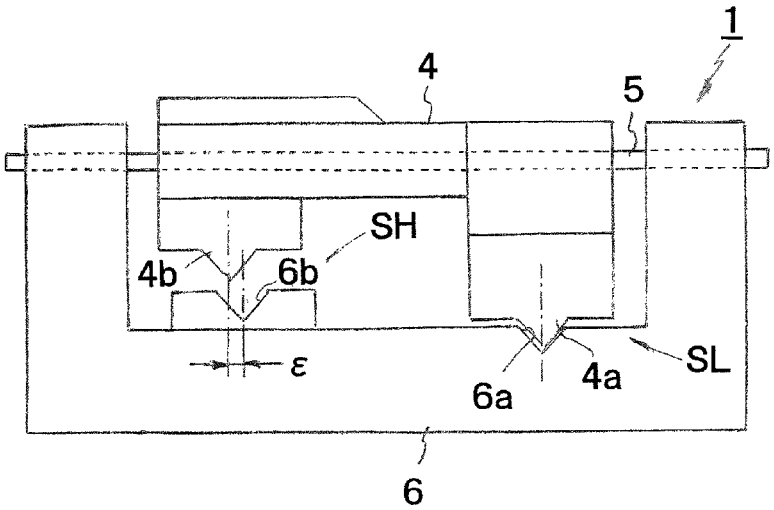
FIG. 10 is an explanatory view illustrating the engagement state of a concave portion and a convex portion in a low beam stopper portion of a light amount control mechanism according to a third exemplary embodiment of the presently disclosed subject matter.
Figure 11:
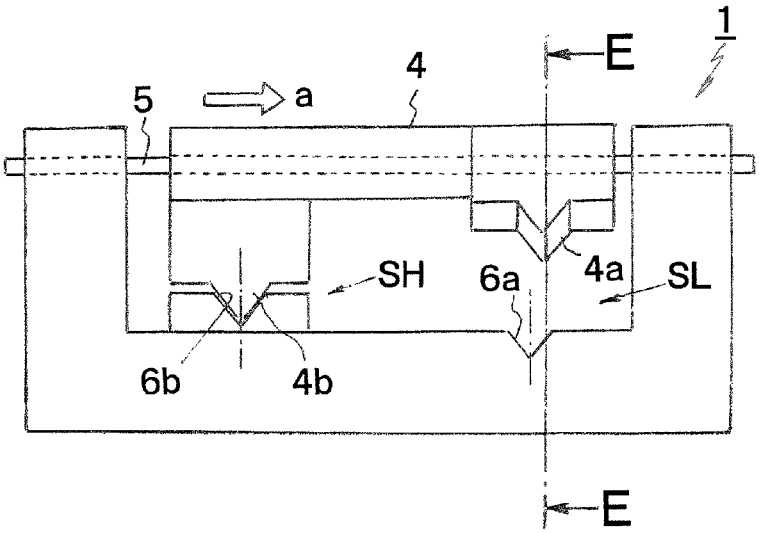
FIG. 11 is an explanatory view showing the engagement state of a concave portion and a convex portion in the high beam stopper portion of the light amount control mechanism according to the third exemplary embodiment.
Figure 12:
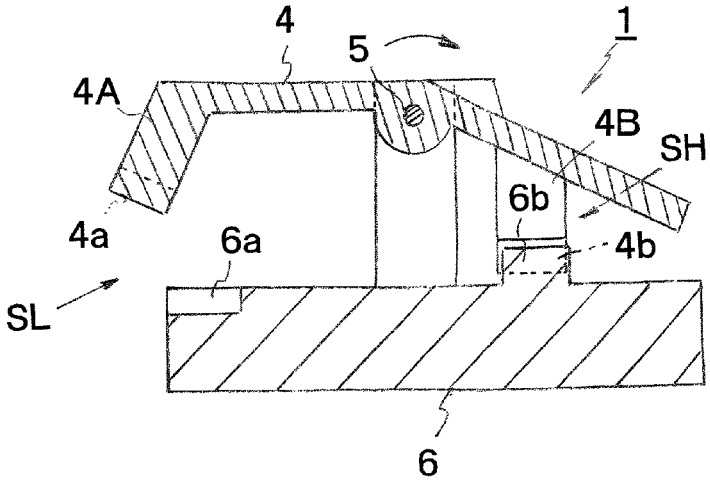
FIG. 12 is a cross-sectional view taken along line E-E of FIG. 11.

FIG. 10 is an explanatory view illustrating an engagement state of a concave portion and a convex portion in a low beam stopper portion of a light amount control mechanism according to the third exemplary embodiment of the presently disclosed subject matter, FIG. 11 is an explanatory view showing the engagement state of a concave portion and a convex portion in a high beam stopper portion of the light amount control mechanism according to the third exemplary embodiment, and FIG. 12 is a cross-sectional view taken along line E-E of FIG. 11. In these drawings, the same reference numerals are assigned to the same elements as those shown in FIGS. 7 to 9, and descriptions thereof will be omitted.

The present exemplary embodiment is configured such that, as shown in FIG. 10, when the movable shade 2 is in the first position, that is, when the convex portion 4*a* and the concave portion 6*a* that constitute the low beam stopper SL are in the engaged state, the convex portion 4*b* on the bracket 4 side and the concave portion 6*b* on the housing 6 side that constitute the high beam stopper SH may be arranged so that the respective center positions are offset by a distance ε (offset amount) illustrated in the drawing in the rotation axis direction.

Therefore, when the position of the movable shade 2 is switched from the first position shown in FIG. 10 to the second position shown in FIG. 11, as the movable shade 2 rotates, the convex portion 4*b* and the concave portion 6*b* which have been offset from each other in the rotation axis direction can engage with each other as shown in FIG. 11. At that time, the movable shade 2 can move by the offset amount ε in the rotation axis direction (the direction of the arrow "a" in FIG. 11), thereby allowing the movable shade 2 to perform three-dimensional movement of rotation and axial movement.

In the above-described exemplary embodiments, the V-shaped convex portion constituting the stopper of the movable shade is formed on the bracket side and the V-groove-shaped concave portion is formed on the housing side, respectively; however the presently disclosed subject matter is not limited thereto, and, the convex portion may be formed on the housing side and the concave portion may be formed on the bracket side.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A light amount control mechanism for a vehicle headlamp comprising:

a movable shade configured to be rotatably supported by a housing and selectively pivots to a first position or a second position to switch a shielding amount of light emitted from a light source;

an actuator configured to drive the movable shade; and a stopper configured to position and hold the movable shade at the first position and the second position, the stopper being constituted by a V-shaped convex portion formed on any one of the movable shade and the housing and a V-groove-shaped concave portion formed on the other thereof as a pair.

2. The light amount control mechanism according to claim 1, wherein center positions of the pair of convex portion and concave portion that engage with each other in the first position or the second position are offset in the rotation axis direction of the movable shade.

3. The light amount control mechanism according to claim 1, wherein the V-shaped convex portion and the V-groove shaped concave portion include a first engagement set including a pair of a convex portion and a concave portion that engage with each other when the movable shade is in the first position, and a second engagement set including another pair of a convex portion and a concave portion that engage with each other when the movable shade is in the second position, and center positions of the convex portion and the concave portion of at least one of the first engagement set and the second engagement set are offset from each other in the rotation axis direction of the movable shade.

* * * * *